US008277573B2

(12) United States Patent
Abbruzzese et al.

(10) Patent No.: US 8,277,573 B2
(45) Date of Patent: Oct. 2, 2012

(54) PROCESS FOR THE PRODUCTION OF A GRAIN ORIENTED MAGNETIC STRIP

(75) Inventors: Giuseppe Abbruzzese, Rome (IT); Stefano Cicale', Rome (IT); Stefano Fortunati, Rome (IT)

(73) Assignee: Centro Sviluppo Materiali S.p.A., Rome (IT)

( * ) Notice: Subject to any disclaimer, the term of this patent is extended or adjusted under 35 U.S.C. 154(b) by 184 days.

(21) Appl. No.: 12/595,659

(22) PCT Filed: Apr. 18, 2008

(86) PCT No.: PCT/IB2008/051498

§ 371 (c)(1), (2), (4) Date: Jun. 28, 2010

(87) PCT Pub. No.: WO2008/129490

PCT Pub. Date: Oct. 30, 2008

(65) Prior Publication Data

US 2010/0300583 A1 Dec. 2, 2010

(30) Foreign Application Priority Data

Apr. 18, 2007 (IT) ..... RM2007A0218

(51) Int. Cl.
*H01F 1/147* (2006.01)

(52) U.S. Cl. ..... 148/111; 148/307

(58) Field of Classification Search ..... None
See application file for complete search history.

(56) References Cited

U.S. PATENT DOCUMENTS

| | | | | |
|---|---|---|---|---|
| 4,588,453 | A * | 5/1986 | Shimizu et al. | 148/111 |
| 4,592,789 | A | 6/1986 | Kawamo et al. | |
| 6,488,784 | B1 * | 12/2002 | Fortunati et al. | 148/308 |
| 6,524,400 | B1 * | 2/2003 | Pircher et al. | 148/111 |
| 2004/0231752 | A1 | 11/2004 | Nanba et al. | |

FOREIGN PATENT DOCUMENTS

| | | | |
|---|---|---|---|
| EP | 0566986 | A | 10/1993 |
| EP | 0648847 | A | 4/1995 |
| EP | 1411139 | A | 4/2004 |
| JP | 7258738 | A | 10/1995 |

* cited by examiner

*Primary Examiner* — John Sheehan
(74) *Attorney, Agent, or Firm* — Browdy and Neimark, PLLC

(57) ABSTRACT

A process for the production of a grain oriented magnetic strip, made of steel containing 2.3 to 5.0% of silicon, obtained by producing a hot-rolled sheet containing a distribution of second phases capable of controlling the secondary recrystallization by means of a two-step hot-rolling with an intermediate annealing, and by changing it into the final product.

9 Claims, No Drawings

PROCESS FOR THE PRODUCTION OF A GRAIN ORIENTED MAGNETIC STRIP

The present invention refers to a process for the production of grain oriented magnetic strips made of silicon steel. These strips are generally used in the manufacturing of the magnetic cores of electric transformers.

Products available on the market are graded on the basis of their magnetic characteristics (defined in Standard UNI EN 10107):

"Magnetic induction at 800 A/m" B800 (expressed in Tesla), measured with an applied magnetic field equal to 800 A/m;

Power losses (expressed in W/kg) measured at preset magnetic induction values (1.5 T for P15, 1.7 T for P17).

According to the cited Standard, it is defined as "grain oriented" a product having B800≧1.75 T and as "grain oriented with high magnetic permeability" a product having B800≧1.88 T. The evolution of production processes in the last years resulted in the B800 of grain oriented products available on the market to be currently of ≧1.80 T.

From a metallurgical viewpoint, these products have a grain size ranging from some mm to some cm, with the <100> direction aligned to the rolling direction and the {110} plane parallel to the rolling plane. The more the <100> direction is aligned to the rolling direction, the best the magnetic characteristics are.

Attainment of the best metallurgical results is influenced in a complex manner by parameters distributed along the entire production process, from steel preparation to operating conditions in which the final annealing is carried out.

An important role in the production process is played by the precipitation of second phases, typically sulphides and/or selenides and/or nitrides, finely distributed into the matrix, determinant for controlling the grain growth during the secondary recrystallization process.

Traditional technologies for production of grain oriented magnetic steel (see, e.g., IT1029613) envisage the attainment of this distribution of second phases, capable of controlling the secondary recrystallization, during hot-rolling and the subsequent step of annealing the hot-rolled sheet.

Precipitation is obtained by the presence in the alloy of controlled contents of elements capable of forming second phases (sulphides and/or selenides and/or nitrides), the heating of the slab before the hot-rolling up to very high temperatures (>1300° C.), so as to dissolve a significant amount of the second phases, precipitated in a form coarse and uncapable of controlling the secondary recrystallization during the casting, so that they may re-precipitate during the hot-rolling and the subsequent annealing of the hot-rolled sheet, in a form capable of controlling the secondary recrystallization.

The high temperatures for heating the slab before the hot-rolling cause remarkable problems from different viewpoints:

plant-related, with the need to use special heating furnaces for the treatment of slabs at the above-mentioned temperatures, maintenance-related; in fact the temperature used is higher than the temperature of formation of the liquid slag, which by kneading with the moving mechanisms of the furnace creates remarkable maintenance problems, of the surface quality of the final products, in fact at temperatures so high the slab surface is subjected to injuries that are found also onto the final product, of power consumption, in fact at temperatures so high the power lost due to heat dissipation of the furnace is remarkable.

Among the solutions singled out for the making of these steels, the precipitation of second phases, in a form capable of controlling the secondary recrystallization, is obtained by a nitriding treatment carried out after or during the decarburisation annealing, immediately before the secondary recrystallization annealing (EP0339474).

Thus, there is no longer the need to precipitate into the hot-rolled sheet the second phases already in a form capable of controlling the secondary recrystallization, by preventively dissolving them during the slab heating before the hot-rolling; as a consequence, the slab-heating temperature can be lowered below the dissolution temperature (<1200° C.).

A further development of the above-mentioned technology for the production of grain oriented magnetic steel by nitriding is represented by (EP0950120), in which the slab before hot-rolling is subjected to a heating treatment at temperatures intermediate between the temperatures required to obtain the dissolution of a significant amount of second phases (IT1029613) and those required to prevent their dissolution (EP0339474).

However, these operation steps entail several drawbacks.

A first drawback is related to the fact that anyhow the content of second phases that are dissolved during the slab heating before the hot-rolling strongly depends, besides on the heating temperature, on the solubility product of the second phases at issue (hence, e.g. in the case of AlN, on the chemical activities, and therefore the concentrations of Al and N in solution, and likewise for the other nitrides, sulphides and/or selenides considered).

This mandates, both when wishing to dissolve a significant amount of second phases (IT1029613), and to prevent dissolution (EP0339474), as well as in case an intermediate position between the two extremes is sought (EP0950120), to control very strictly besides the heating temperature also the concentration of those elements capable of forming second phases.

In spite of highly controlled steelmaking practices being adopted, unavoidable fluctuations in the production process cause fluctuations in the concentration of elements capable of forming second phases and therefore of the related chemical activities, such that a strict control of the dissolution and re-precipitation of the second phases becomes very difficult, with an unavoidable negative consequence both on product quality and production yields.

A further drawback is that the second phases, completely or partially dissolved during the slab heating prior to the hot-rolling, owing to kinetic reasons do not completely precipitate during the hot-rolling, but remain in the oversaturated solution. Precipitation of these phases occurs during the annealings carried out at subsequent moments of the process, in particular during the annealing of the hot-rolled sheet and the subsequent decarburisation annealing. This situation mandates, in order to prevent an overly fine or dishomogeneous precipitation, to subject to a very strict control the related process steps.

Moreover, in case the slab heating before the hot-rolling is carried out at temperatures lower than those needed for the dissolution of the second phases precipitated during the casting (EP0339474) there is the drawback that, owing to the weak inhibition present in the sheet during the hot-rolling and the subsequent annealing of the hot-rolled sheet, the grain size of the sheets before the cold-rolling is quite big (in the order of magnitude of several hundreds of μm; the related microstructure and the low density of grain edges in a metal matrix make the material particularly sensitive to any crack propagation phenomena. Accordingly, the sheet is intrinsically brittle and prone to breaking during the cold-rolling, to the point that it is very difficult to increase Si wt % beyond the 3.2%.

Therefore, in the specific field there subsists the need to improve the quality of the grain oriented magnetic strip, concomitantly reducing the complexity of the production cycle and the extent of power consumptions.

With the adoption of the process according to the present invention the above-mentioned needs are satisfied, further offering other advantages that will be made evident hereinafter.

With the present invention it is possible to carry out a process for the production of a grain oriented silicon steel strip for electromagnetic applications obtained through the production of a hot-rolled sheet containing a distribution of second phases capable of controlling the secondary recrystallization, and its change into the final product.

A first embodiment of the present invention is a process for the production of a grain oriented magnetic strip by the continuous casting of a steel, containing silicon in a weight percent (wt %) comprised between 2.3 and 5.0. Si role is that of increasing the alloy resistivity, thereby reducing the power lost into the magnetic core of the electric machine by effect of eddy currents. For concentrations lower than the minimum ones reported this reduction does not occur sufficiently, whereas for concentrations higher than the minimum ones reported the alloy becomes so brittle that changing it into the final product proves difficult.

Moreover, the alloy contains at least two elements of the series B, Al, Cr, V, Ti, W, Nb, Zr, in a concentration equal to 1.5 times the amount required to combine stoichiometrically with the nitrogen present, capable of forming, in the Fe—Si matrix, nitrides stable at high temperature and at least one selected from Mn and Cu in an overstoichiometric amount with respect to the present sulphur and/or selenium, capable of forming, in the Fe—Si matrix, sulphides and/or selenides stable at high temperature; said alloy should further contain, before slab casting, a concentration of N comprised between 20 and 200 ppm, and/or a concentration of S or Se or both so that (S+(32/79)Se) be comprised in the range of from 30 to 350 ppm.

An excessive concentration of the elements capable of forming second phases is anyhow detrimental to the attainment of a well-oriented secondary recrystallization.

Studies carried out by the authors highlighted that the parameter that best controls the precipitation phenomenon is the sum of the molar concentrations of the elements capable of forming precipitates, represented by quantities $F_N$ and $F_S$ defined in formulas (1) and (2) respectively for nitrides and sulphides/selenides.

$$F_N = \frac{[B]}{M_B} + \frac{[Al]}{M_{Al}} + \frac{[Cr]}{M_{Cr}} + \frac{[V]}{M_V} + \frac{[Ti]}{M_{Ti}} + \frac{[W]}{M_W} + \frac{[Nb]}{M_{Nb}} + \frac{[Zr]}{M_{Zr}} \quad (1)$$

$$F_S = \frac{[Mn]}{M_{Mn}} + \frac{[Cu]}{M_{Cu}} \quad (2)$$

where [X] represents the weight concentration of element X in ppm and $M_x$ the related atomic weight.

Within the scope of the teachings of this invention the two quantities reported above should be comprised in the following ranges:

$$1.5 \cdot \left(\frac{[N]}{M_N}\right) < F_N < 40 \quad (3)$$

$$\frac{\left([S] + \frac{32}{79}[Se]\right)}{M_S} < F_S < 100 \quad (4)$$

where the lower limit represents the condition of stoichiometric ratio with N, S and/or Se, and the upper limit is that beyond which precipitation becomes dishomogeneous and not capable of controlling the oriented secondary recrystallization.

N and S contents lower than the lowest limits claimed generate anyhow an amount of second phases insufficient to control the phenomenon of oriented secondary recrystallization, whereas concentrations higher than the ones claimed uselessly increase production costs and can cause alloy brittleness phenomena.

Apart from the indicated elements, and the Fe and unavoidable impurities, the alloy may optionally contain up to 800 ppm C, Sn, Sb, As, in a concentration such that the sum of their weight concentrations does not exceed 1500 ppm, P, Bi such that the sum of their weight concentrations does not exceed 300 ppm.

Carbon presence in the alloy has a positive effect on the magnetic characteristics, an increase in its concentration improves the orientation of the crystal grains in the final product and makes the grain size more homogeneous. Being per se detrimental to the magnetic characteristics of the final product (in fact, carbides by interacting with the walls of the magnetic domains generate dissipative phenomena that increase the iron losses), before the secondary recrystallization annealing it is removed by annealing under decarburising atmosphere. >800 ppm C contents in the alloy yield no significant improvements of the characteristics of the final product and considerably increase decarburisation annealing costs.

Carbon during the quenching process generates hard phases and fine carbides that increase the strain hardening rate during the cold-rolling; moreover, Carbon in solid solution, by migrating on the dislocations, during the interpass ageing process (holding at a temperature of 150-250° C. after some cold deformation passes) favours the formation of new dislocations. All this has an homogenising effect on the microstructure and produces a more homogeneous and better oriented final grain. Contrarily to what occurs in traditional production technologies, where the absence of Carbon in the alloy generates in the final product colonies of small grains having non-favourable orientation that drastically worsen the magnetic characteristics (B800<1800 mT), in the process claimed in this invention, thanks to the specific hot-rolling process that per se tends to homogenise the microstructure, the absence of Carbon, in spite of the worsening of the magnetic characteristics, generates anyhow a final product not manifesting the described phenomenon and possessing good magnetic characteristics (B800>1800 mT).

The elements Sn, Sb, As and P and Bi contribute to hinder dislocation motion, increase them also the strain hardening rate in cold-rolling, favouring the attainment of a well-oriented secondary recrystallization. Concentrations higher than the indicated ones yield no additional benefits and can induce brittleness phenomena in the material.

A first embodiment of the present invention is also the continuous casting of the steel in the form of a slab, so as to ensure a solidification time lower than 6 minutes. The slab thus solidified is, directly and without being subjected to heating, processed according to the following operations in sequence:

first step of the hot-rolling (first hot-rolling step), to a thickness of 15-30 mm, with a reduction ratio of at least 50%; said rolling being carried out in a time interval lower than 100 s after complete solidification of the steel at a surface temperature ($T_{sur}$), before the start of said rolling, comprised between 1050° C. and 1300° C. and a core temperature ($T_{core}$), comprised between 1100° C. and 1400° C., as well as a difference ($T_{core}-T_{sur}$) greater than 30° C. (with $T_{core}$ always greater than $T_{sur}$), $T_{sur}$ being the temperature of the slab section at a depth equal to 20% of the thickness and $T_{core}$ being the temperature of the section at the core of the slab thickness;

normalizing annealing of the rolled slab at a temperature of 900-1150° C. for a time of 1-30 min;

second step of the hot-rolling (second hot-rolling step), at rolling starting temperatures comprised between 880° C.-1150° C., until obtaining a sheet of <5-mm thickness;

cooling and coiling of the sheet thus obtained.

The hot-rolled sheet thus produced is changed into the final product through the following process steps carried out in sequence:

optional annealing of the hot-rolled sheet;

cold-rolling until obtaining a strip, decarburization annealing and primary recrystallization of the strip, applying of an annealing separator onto the strip surface, secondary recrystallization annealing of the strip, and wherein the sheet and/or the strip is optionally nitrided.

When the slab solidification time, i.e. the time elapsing between complete solidification and the starting of the first step of the rolling, exceeds the indicated limits, or when the rolling temperatures both in terms of $T_{core}$ and $T_{sur}$ or their difference, exceed the indicated limits, the magnetic characteristics of the final product worsen remarkably.

Though the metallurgical reasons due to which it is necessary to cast and subject to the first step of the hot-rolling the slabs within the claimed times and temperatures have not been fully explained, studies carried out by the present inventors demonstrated that under the claimed conditions, given the very short times of slab permanence within the temperature interval of thermodynamic stability of the second phases used (sulphides and/or selenides and nitrides), the slab gets to the starting of the first step of the hot-rolling under conditions in which the precipitated amount of sulphides and/or selenides and nitrides is nil or very small, and the elements apt to form them are in a condition of oversaturated solution; hot-rolling, under the claimed temperature conditions, by producing a high density of dislocations provides a high density of nucleation sites. Under these conditions, precipitation occurs concomitantly to rolling and in a form capable of controlling the secondary recrystallization, particularly in the volume fraction comprised between the surface of the slab and its section at 25% of the thickness, thanks to thermal gradient conditions inverted with respect to what is carried out with the conventional processes. As it is well-known to a person skilled in the art, this zone comprised between the surface and 25% of the thickness is the most important one for obtaining a well-oriented secondary recrystallization.

When the slab solidification time, i.e. the time elapsing between complete solidification and the start of the first step of the rolling, exceeds the maximum limits indicated, precipitation starts before the start of the first hot-rolling. The same effect is obtained when the temperatures at the start of the first step of the rolling ($T_{sur}$ or $T_{core}$ or both) are below the minimum limits indicated. The end result is a precipitation of second phases not capable of controlling the secondary recrystallization.

Likewise, when the rolling starting temperatures exceed the maximum limits indicated, a process of recovery of the dislocations generated by the first step of the rolling prevents the formation of a high density of nucleation sites and the end result is once more a distribution of second phases not capable of controlling the secondary recrystallization.

Reduction ratios lower than the minimum one indicated determine a dislocation density insufficient to precipitate the second phases in a manner capable of controlling the secondary recrystallization.

Moreover, the reduction ratios effected in the hot-rolling of the cast slab and the times and temperatures of the normalizing annealing of the slab after the first step of the rolling are such that the slab undergoes a partial recrystallization, concentrated in the surface zone down to 25% of the thickness. In this zone, recrystallization is favoured owing to a twofold reason: on the one hand, the presence of a high density of deformation structures concentrated here, due both to roll friction and thermal inversion conditions ($T_{sur}<T_{core}$) in which deformation is carried out; on the other hand, the surface decarburization occurring during the normalizing annealing by slag-contained Oxygen.

This recrystallization causes an increase of Goss grains in the slab surface zone (up to 25% of the thickness), entailing an increase of Goss nuclei before the secondary recrystallization and therefore a final product with a more homogeneous and better-oriented grain.

The annealing moreover serves to precipitate the particles of second phases that, due to kinetic reasons, do not precipitate completely during the first step of the hot-rolling.

When the temperature or the normalizing annealing times drop below the claimed minimum limits, or when the first step of the hot-rolling does not take place under the claimed core-surface thermal inversion conditions, recrystallization does not occur correctly and therefore the final product has poor magnetic characteristics; under these conditions, moreover, controlling of the second step of the hot-rolling becomes difficult.

Slab normalizing annealing temperatures and/or times the exceeding the claimed maximum limits yield no further advantages and uselessly increase production costs.

A second embodiment of the present invention is a process aimed to the obtainment of a grain oriented magnetic strip, in which the cast steel contains at least 250 ppm C, Al with a concentration comprised between 200 ppm and 400 ppm, hot-rolled sheet annealing is carried out for an overall time of 20-300 s with one or more stops at temperatures higher than 850° C., followed by cooling down to a quenching starting temperature comprised in the range of 750-850° C., and subsequently water-quenched.

This annealing serves both to recrystallize the sheet after the second step of the hot-rolling, which by further increasing the density of the Goss grains improves the magnetic characteristics of the final product, and to dissolve the carbides precipitated during the sheet cooling and coiling after the hot-rolling, and, through quenching, to generate a high density of hard phases, fine carbides and Carbon in solid solution useful during the cold-rolling process in order to increase the strain hardening of the steel, thereby optimizing the textures of the material. This has the effect of producing a secondary recrystallization with a more homogeneous and better-oriented grain.

When the annealing is carried out at temperatures lower than the minimum ones indicated, it becomes difficult to initiate the quenching process at the temperatures highlighted, which are those yielding the maximum density of fine carbides and Carbon in solid solution. Moreover, annealing temperatures lower than the minimum limit indicated do not ensure that the recrystallization process occurs in a manner effective to guarantee the mentioned advantages.

According to a third embodiment of the present invention, the cold-rolling is carried out in single pass or in multiple passes with an intermediate annealing followed by quenching, wherein the last pass is carried out, with a reduction ratio of at least 80%, holding the sheet temperature at a value comprised between 170 and 300° C. prior to at least two rolling steps subsequent to the first step; the function of this holding within the claimed temperature interval is to favour the migration of Carbon in solid solution onto the dislocations generated by the rolling process, thereby favouring the generation of new dislocations. This reverberates on the magnetic quality of the final product, manifesting a more homogeneous and better-oriented grain; reduction ratios lower than the minimum one indicated cause the described phenomena not to be sufficiently effective to guarantee this improvement of the characteristics; holding temperatures lower than the minimum ones claimed prevent the phenomenon of Carbon migration onto the dislocations from occurring in a sufficiently effective manner, temperatures higher than the maximum ones claimed yield no significant improvements and entail phenomena of rapid degradation of the rolling oil utilised, making it difficult to industrialise the process.

According to a fourth embodiment of the present invention, the decarburisation annealing and primary recrystallization of the sheet is carried out at a temperature comprised between 780° C. and 900° C. under wet Nitrogen+Hydrogen atmosphere, such that the ratio between partial pressure of $H_2O$ and partial pressure of $H_2$ be lower than 0.70 for a time comprised between 20 and 300 s, optionally carried out with a heating rate of at least 150° C./s in the temperature range comprised between 200° C. and 700° C.

Temperatures lower than the minimum one indicated and times lower than the minimum value indicated cause a non-optimal recrystallization of the sheet that worsens the magnetic characteristics, whereas temperatures higher than the maximum ones indicated, as well as $$\frac{P_{H_2O}}{P_{H_2}}$$

ratios higher than the maximum value indicated, cause an excessive oxidation of the sheet surface, worsening the magnetic characteristics, as well as the surface quality of the final product.

According to a fifth embodiment of the present invention, the secondary recrystallization annealing is carried out with a heating gradient comprised between 10 and 40° C./h, to a temperature comprised between 1000 and 1250° C., under Nitrogen+Hydrogen atmosphere and a subsequent holding of this temperature, under Hydrogen atmosphere, for a time comprised between 5 and 30 h.

Heating rates higher than the maximum one indicated cause a too rapid evolution of the distribution of second phases formed during the hot-rolling, required for controlling the secondary recrystallization, so that the latter is not adequately controlled and the result is a worsening of the magnetic characteristics of the final product. Heating rates lower than the minimum one indicated yield no special advantage and unnecessarily lengthen the annealing times; stop temperatures lower than the minimum one indicated cause the purification process for the elimination of Nitrogen, Sulphur and/or Selenium not to take place in a correct manner, whereas temperatures higher than the maximum ones indicated entail a worsening of the surface quality of the final product.

Secondary recrystallization annealing is preceded by the applying, onto the strip surface, of an annealing separator comprising substantially MgO.

According to a further embodiment of the present invention, the sheet may be subjected to a nitriding treatment that, through the sheet surface, permeates Nitrogen, which, by reacting with the other alloy elements present in the steel and capable of forming nitrides, generates their precipitation, summing up with that generated during the hot-rolling, strengthening the controlling of the grain growth during the secondary recrystallization process.

The adoption of a nitriding process according to the teachings of this invention results in a decrease of the fluctuations of the magnetic characteristics in the final product, as well as a further improvement thereof.

The nitriding operation is carried out after the hot-rolling, in at least one of the following annealings:

- during annealing of the hot-rolled sheet, by adding ammonia to the annealing atmosphere;
- during annealing of the hot-rolled sheet, by adding ammonia to the annealing atmosphere, in an annealing step of a time length lower than the total annealing time; in this case, there shall have to be adopted suitable contrivances needed to separate the atmosphere of the furnace zone in which ammonia is added from the remaining part of the furnace;
- during decarburization annealing and primary recrystallization of the cold-rolled sheet, by adding ammonia to the annealing atmosphere;
- during decarburization annealing and primary recrystallization of the cold-rolled sheet, by adding ammonia to the annealing atmosphere, in an annealing step of a time length lower than the total annealing time; in this case, there shall have to be adopted suitable contrivances needed to separate the atmosphere of the furnace zone in which ammonia is added from the remaining part of the furnace;
- after annealing of the hot-rolled sheet or after decarburization annealing, in an annealing specifically dedicated to the nitriding process, conducted at a temperature comprised between 800° C. and 900° C. by using an ammonia-containing Nitrogen+Hydrogen atmosphere.

In all of the above-mentioned cases, introduced N content should be comprised between 30 and 300 ppm; N contents lower than the minimum ones indicated are not sufficient to obtain the mentioned stabilisation effects, whereas N contents higher than the maximum limits mentioned yield no further beneficial effects and can cause defectiveness in the surface quality of the final product.

The nitriding may optionally be carried out also during secondary recrystallization annealing, within the temperature range comprised between the annealing starting temperature and the temperature at which the secondary recrystallization ends, with one or both of the following operations:

- by using an annealing atmosphere comprised of Nitrogen in a percent comprised between 80% and 95%, N contents lower than the minimum limits set are not effective, whereas higher N contents can cause superficial defectiveness in the final product;
- by adding metal nitrides capable of releasing Nitrogen between the temperatures of 700° C. and 950° C. during the temperature rise of the final annealing (such as, e.g., MnN, CrN) to the annealing separator, so that the weight of N thus added to the separator be comprised between 0.5% and 3%, N contents lower than the minimum limits set are not effective, whereas higher N contents can cause surface defectiveness in the final product.

The adoption of the process according to the invention entails the attainment of the following advantages.

The process for the production of a sheet proposed with this invention is distinguished, with respect to existing technologies, by the elimination of the slab-heating step that precedes the hot-rolling; therefore, first of all there are eliminated the technical and economic limitations related to conventional processes utilising the slab-heating prior to the hot-rolling.

The slab hot-rolling, conducted according to the modes of the present invention and in particular within the range of claimed temperatures, and above all in the condition whereby the core is hotter than the surface, makes much more reproducible and reliable the process for the formation of the second phases, capable of controlling the phenomenon of oriented secondary recrystallization, directly during the hot-rolling step.

In fact, by applying these operating conditions the precipitation of the second phases, capable of controlling the secondary recrystallization, occurs mainly during the first step of the hot-rolling, with no need of controlling the dissolution of the second phases, precipitated in coarse form during the casting, as instead is the case in the traditional processes, and it further occurs during the normalization annealing of the rolled slab.

A further advantage is that the recrystallization occurring in the slab surface zone during the normalization annealing yields a hot-rolled sheet with grain of a size lower than that present in sheets produced with the traditional processes; this allows to increase Silicon content beyond the levels practicable with the traditional technologies.

Moreover, the specific process of hot-rolling in two steps separated by an annealing allows improved controlling, both of the form and the dimensional stability of the hot-rolled sheet produced, both along the width and the length thereof; this reverberates positively on dimensional stability and form of the final product.

Hereto, a general description of the present invention was given. With the aid of the following examples, hereinafter a description of embodiments thereof will be provided, aimed at making better understood the objects, features, advantages and application modes thereof.

The following examples are to be construed as illustrative of the invention and not limitative of its scope.

EXAMPLE 1

Two different alloys having the following chemical compositions were cast:

Composition A:

Si: 3.2%, C: 450 ppm, N: 95 ppm, S: 230 ppm, Al: 180 ppm, Cr: 600 ppm, B: 40 ppm, Zr: 100 ppm, Mn: 0.20%, Cu: 0.25%, Sb: 350 ppm, As: 250 ppm, the remaining part being iron and unavoidable impurities.

Composition B:

Si: 3.2%, C: 450 ppm, N: 90 ppm, S: 250 ppm, Al: 500 ppm, Cr: 1000 ppm, B: 30 ppm, Zr: 500 ppm, Mn: 0.15%, Cu: 0.20%, Sb: 340 ppm, As: 260 ppm, the remaining part being iron and unavoidable impurities.

On the basis of the above-defined chemical compositions, the quantities shown in Table 1 were calculated.

TABLE 1

| Quantities obtained from chemical composition | | |
|---|---|---|
| | Composition A (*) | Composition B (**) |
| $\frac{[N]}{M_N}$ | 6.8 | 6.4 |
| $\frac{\left([S] + \frac{32}{79}[Se]\right)}{M_S}$ | 7.2 | 7.8 |
| $F_N$ | 23 | 46 |
| $F_S$ | 76 | 59 |

(*) Conditions complying with the invention
(**) Conditions not complying with the invention Casting was carried out, yielding 4 flat semiproducts per each chemical composition, having a thickness of 70 mm, completely solidified in the times indicated on the first column of Table 2.

The semi-finished products thus obtained were subjected to the first step of the hot-rolling after a time of 60 s from complete solidification of the slab with a reduction ratio of 60%, to a thickness of 28 mm; cooling conditions were regulated so that the thermal conditions of the semiproduct, at the start of the first step of the hot-rolling, were those indicated in Table 2 (where $T_{sur}$ is the temperature of the semiproduct section at a depth equal to 20% of the thickness and $T_{core}$ is the temperature at mid-thickness of the semiproduct).

TABLE 2

| Solidification and first rolling conditions | | | | |
|---|---|---|---|---|
| | | rolling starting temperatures | | |
| semiproduct # | complete solidification time | Tsur [° C.] | Tcore [° C.] | Tcore − Tsur [° C.] |
| 1(*) | 1 min | 1080 | 1380 | 300 |
| 2(*) | 2 min 30" | 1110 | 1310 | 200 |
| 3(*) | 3 min | 1150 | 1260 | 110 |
| 4(**) | 10 min | 1160 | 1220 | 60 |

(*)Conditions complying with the invention
(**)Conditions not complying with the invention The semiproducts, once subjected to the first step of the hot-rolling, were subjected to normalizing annealing at 1140° C. and held at this temperature for a 15-min time.

The semiproducts were subsequently subjected to the second step of the hot-rolling, with a rolling starting temperature of 1120° C., to a thickness of 2.3 mm and air-cooled to room temperature.

The hot-rolled sections thus obtained were then subjected to the following thermomechanical cycle:

- annealing at 900° C.×260 s, cooling to 780° C. and water quenching;
- cold-rolling without intermediate annealing to a thickness of 0.30 mm, with a cold reduction ratio of 87%. The rolling was carried out by performing an "interpass ageing" (holding of the sheet temperature at a value comprised between 170 and 300° C. prior to at least two rolling steps) at 240° C., to the thicknesses of 1.00 mm, 0.67 mm, 0.43 mm;
- decarburization annealing and primary recrystallization at 850° C.×180 s, with a ratio between partial pressure of $H_2O$ and of $H_2$ equal to 0.56;
- coating with MgO-based annealing separator;

secondary recrystallization annealing with a heating rate of 15° C./h up to 1200° C. in Nitrogen+Hydrogen 1:3, a stop at 1200° C. in Hydrogen for 10 h.

The magnetic characteristics obtained on the final product are indicated in Table 3.

TABLE 3

Magnetic characteristics

| | Chem. Composition A(*) | | Chem. Composition B(**) | |
|---|---|---|---|---|
| semiproduct # | [T] | P17 [W/kg] | B800 [T] | P17 [W/kg] |
| 1(*) | 1850 | 1.25 | 1630 | 2.9 |
| 2(*) | 1870 | 1.25 | 1590 | 3.0 |
| 3(*) | 1860 | 1.27 | 1610 | 2.9 |
| 4(**) | 1650 | 2.8 | 1605 | 2.9 |

(*)Conditions complying with the invention (**)Conditions not complying with the invention

EXAMPLE 2

Four different steel alloys having the following chemical compositions were cast:

Carbon concentration in the four alloys was equal to:

Alloy A: 15 ppm

Alloy B: 120 ppm

Alloy C: 350 ppm

Alloy D: 500 ppm

As to the other elements, in all four different alloys it was obtained:

Si: 3.3%, N: 100 ppm, S: 200 ppm, Al: 300 ppm, Cr: 600 ppm; V: 80 ppm; Ti: 30 ppm, Mn: 0.25%; Cu: 0.20%; Sn: 750 ppm; Bi: 30 ppm, the remaining part being iron and unavoidable impurities.

On the basis of the above-defined chemical compositions the following quantities were calculated, which by being independent from Carbon concentration assume the same value for all four of the alloys produced:

$$\frac{[N]}{M_N} = 7.1$$

$$\frac{\left([S] + \frac{32}{79}[Se]\right)}{M_S} = 6.2$$

$$F_N = 25$$

$$F_S = 77$$

For each chemical composition, 6 flat semiproducts having a thickness of 90 mm were cast, completely solidified in a 3-min time. Then, the cooling conditions of the semiproducts once solidified were controlled, so as to carry out the first step of the hot-rolling, with a reduction ratio of 70%, down to a thickness of 27 mm, under the thermal conditions depicted in Table 4.

TABLE 4

Thermal conditions under which the first step of the hot-rolling was carried out;

| semi product # | Time elapsed from complete solidification [s] | $T_{sur}$ [° C.] | $T_{core}$ [° C.] | $T_{core} - T_{sur}$ [° C.] |
|---|---|---|---|---|
| 1(*) | 30 | 1190 | 1310 | 120 |
| 2(*) | 50 | 1060 | 1260 | 200 |
| 3(*) | 50 | 1230 | 1290 | 60 |
| 4(*) | 60 | 1160 | 1280 | 120 |
| 5(*) | 80 | 1220 | 1255 | 35 |
| 6(**) | 90 | 1320 | 1330 | 10 |

(*)Conditions complying with the invention (**)Condition not complying with the invention After this first step of the hot-rolling, the cogged semiproducts were subjected to normalizing annealing in a furnace at the temperature of (1040)° C. and held at this temperature for a 10-min time. Then, they were subjected to the second step of the hot-rolling, with a rolling starting temperature equal to 1025° C., to a thickness of 2.8 mm.

The hot-rolled sheets thus produced were then treated with the following thermomechanical cycle:

annealing at 1150° C.×30 s, cooling at 780° C. and water quenching;

cold-rolling without intermediate annealing to a thickness of 0.23 mm, with a cold reduction ratio of 92%.

The rolling was carried out by simulating an interpass ageing (holding of the sheet temperature at a value comprised between 170 and 300° C. prior to at least two rolling steps) at 240° C.×600 s, to the thicknesses of 0.80 mm, 0.50 mm, 0.35 mm.

decarburization annealing and primary recrystallization at 830° C., with a ratio between partial pressure of $H_2O$ and of $H_2$ equal to 0.55 for a time of 30 s, 60 s, 120 s, 220 s, respectively for alloys A, B, C, D;

coating with MgO-based annealing separator;

secondary recrystallization annealing with a heating rate of 20° C./h, to 1210° C. in Nitrogen+Hydrogen 1:3, a stop at 1210° C. in Hydrogen for 12 h.

The magnetic characteristics obtained on the final product are reported in Table 5.

TABLE 5

Magnetic characteristics measured on the final product

| | | Magnetic characteristics obtained | |
|---|---|---|---|
| | Semiproduct # | B800 [T] | P17 [W/kg] |
| C = 15 ppm | 1(*) | 1840 | 1.19 |
| | 2(*) | 1850 | 1.15 |
| | 3(*) | 1830 | 1.22 |
| | 4(*) | 1845 | 1.15 |
| | 5(*) | 1840 | 1.17 |
| | 6(**) | 1580 | 2.7 |
| C = 120 ppm | 1(*) | 1865 | 1.08 |
| | 2(*) | 1870 | 1.07 |
| | 3(*) | 1875 | 1.10 |
| | 4(*) | 1875 | 1.07 |
| | 5(*) | 1860 | 1.08 |
| | 6(**) | 1560 | 2.98 |
| C = 310 ppm | 1(*) | 1910 | 0.95 |
| | 2(*) | 1905 | 0.97 |
| | 3(*) | 1920 | 0.93 |
| | 4(*) | 1915 | 0.95 |
| | 5(*) | 1905 | 0.93 |
| | 6(**) | 1650 | 2.8 |

TABLE 5-continued

| Magnetic characteristics measured on the final product | | | |
|---|---|---|---|
| | | Magnetic characteristics obtained | |
| | Semiproduct # | B800 [T] | P17 [W/kg] |
| C = 500 ppm | 1(*) | 1940 | 0.85 |
| | 2(*) | 1935 | 0.84 |
| | 3(*) | 1945 | 0.83 |
| | 4(*) | 1935 | 0.86 |
| | 5(*) | 1930 | 0.87 |
| | 6(**) | 1650 | 2.7 |

(*)Conditions complying with the invention
(**)Conditions not complying with the invention

EXAMPLE 3

A steel having the following chemical composition was cast:

Si: 3.1%, C: 300 ppm, N: 140 ppm, S: 200 ppm, Se: 300 ppm, Al: 250 ppm, Cr: 650 ppm, Nb: 150, Mn: 0.20%, Cu: 0.20%, Sn: 250 ppm, As: 320 ppm, P: 70 ppm, the remaining part being iron and unavoidable impurities, into 8 flat semiproducts having a thickness of 80 mm, completely solidified in a time of 3 min 10 s.

On the basis of the above-defined chemical composition, the following quantities were calculated $$\frac{[N]}{M_N} = 10.0$$

$$\frac{\left([S] + \frac{32}{79}[Se]\right)}{M_S} = 10.0$$

$$F_N = 23$$

$$F_S = 68$$

All semiproducts were subjected to the first step of the hot-rolling with a reduction ratio of 75% until obtaining a semiproduct having a thickness of 20 mm, and a time of 60 s to complete solidification of the semi-finished product. Cooling conditions were adjusted so as to have, at the start of the first step of the hot-rolling, the following temperatures:

$T_{sur}$ (at 20% of the thickness below the semiproduct surface)=1200° C., $T_{core}$ (at the core of the solidified piece)=1360° C., with an average difference $T_{core}-T_{sur}$=160° C. (with $T_{core}>T_{sur}$).

The semi-finished products, immediately after this first step of the hot-rolling, without letting them cool down, were subjected to normalizing annealing and treated at the temperatures reported in Table 6 for 25 min.

After this annealing all semiproducts were subjected to the second step of the hot-rolling, with the rolling starting temperature reported in Table 6.

For semiproducts 1 to 7 it was possible to roll them to a thickness of 2.3 mm, whereas for semiproduct 8 it was not possible to carry on the hot-rolling below the thickness of 6 mm, due to a too low starting temperature of the second step of the hot-rolling.

TABLE 6

| Normalizing temperature of the various semiproducts | | |
|---|---|---|
| semiproduct # | Normalization annealing T of cogged semiproduct | Starting T of the second step of the hot-rolling |
| 1(*) | 1145 | 1135 |
| 2(*) | 1135 | 1120 |
| 3(*) | 1000 | 985 |
| 4(*) | 1040 | 1035 |
| 5(*) | 1020 | 1005 |
| 6(*) | 950 | 930 |
| 7(**) | 880 | 870 |
| 8(**) | 850 | 840 |

(*)Conditions complying with the invention
(**)Condition not complying with the invention From the hot-rolled sections deriving from semiproducts #1-7, 2 groups of samples were obtained, each of which was treated, changing it into the final product with one of the two following thermomechanical cycles:

Cycle A:

annealing at 1130° C.×30 s, cooling to 910° C. and stop at this temperature for 60 s, slow cooling to 780° C. and water quenching;

cold-rolling, without intermediate annealing, to a thickness of 0.30 mm with a cold reduction ratio of 87%. The rolling was carried out by simulating an interpass ageing (holding of the strip temperature at a value comprised between 170 and 300° C. prior to at least two rolling steps) at 240° C.×600 s, to the thicknesses of 0.67 mm and 0.43 mm;

decarburization annealing and recrystallization at 870° C.×60 s, at a ratio between partial pressure of $H_2O$ and of $H_2$ equal to 0.65;

coating with MgO-based annealing separator;

secondary recrystallization annealing with a heating rate of 10° C./h to 1100° C. in Nitrogen+Hydrogen 1:3, a stop at 1100° C. in Hydrogen for 15 h.

Cycle B:

Like cycle A in all steps, apart from the cold-rolling that was conducted without the "interpass ageing" procedure.

The magnetic characteristics obtained on the final product are reported in Table 7.

TABLE 7

| Magnetic characteristics measured on the final product | | | | |
|---|---|---|---|---|
| semi-finished | Cycle A | | Cycle B | |
| product # | B800 [mT] | P17 [W/kg] | B800 [mT] | P17 [W/kg] |
| 1(*) | 1920 | 1.08 | 1885 | 1.19 |
| 2(*) | 1915 | 1.10 | 1882 | 1.16 |
| 3(*) | 1930 | 1.05 | 1890 | 1.15 |
| 4(*) | 1935 | 1.01 | 1885 | 1.16 |
| 5(*) | 1932 | 1.03 | 1890 | 1.10 |
| 6(*) | 1938 | 0.99 | 1890 | 1.10 |
| 7(**) | 1570 | 2.9 | 1590 | 2.80 |
| 8(**) | X | X | X | X |

(*)Conditions complying with the invention
(**)Conditions not complying with the invention

EXAMPLE 4

3 flat semiproducts of a thickness equal to 80 mm, having the following chemical composition, were cast:

Si: 3.15%, C: 430 ppm, B: 30 ppm, Al: 80 ppm, W: 120 ppm, Cr: 260 ppm, V: 110 ppm, N: 80 ppm, Mn: 0.2%, S: 80 ppm, Cu: 0.25%, the remaining part being Fe and unavoidable impurities.

On the basis of the above-defined chemical composition the following quantities were calculated:

$$\frac{[N]}{M_N} = 5.7$$

$$\frac{\left([S] + \frac{32}{79}[Se]\right)}{M_S} = 2.5$$

$$F_N = 14$$

$$F_S = 76$$

All semiproducts were completely solidified in 2 min 30 s.

A semiproduct was hot-rolled according to the teachings of this invention, subjecting it to the series of steps described hereinafter.

The semiproduct was subjected to the first step of the hot-rolling during the cooling, with a reduction ratio of 72%, until obtaining a semiproduct having a thickness of 22.4 mm. The first step of the rolling started 60 s after complete solidification of the semiproducts.

Thermal conditions at the start of the first step of the rolling were as follows:

$T_{sur}$ at 20% of the thickness below the surface of the semi-finished product: 1210° C.;

$T_{core}$ at the core of the solidified piece was of 1350° C.;

$T_{core}-T_{sur}$=140° C. (with $T_{core}>T_{sup}$).

The semi-finished product, immediately after this first step of the hot-rolling, without letting it cool down, was subjected to normalizing annealing at 1030° C. and held at this temperature for 15 min. Immediately after discharge from the furnace the semiproduct was subjected to the second step of the rolling, to a thickness of 2.0 mm with a rolling starting temperature equal to 1010° C.

All according to the teachings of this invention.

Departing from the teachings of this invention, the two semiproducts remaining right after the casting were cooled to room temperature. After cooling, the two semiproducts were heated in a furnace for 30 min, at two different temperatures T1 and T2, respectively, with T1<T2. Discharged from the furnace, the semiproducts were hot-rolled to a thickness of 2.0 mm.

Thermal conditions of the semiproducts at the start of the rolling were as follows:

on surface (at 20% of the thickness), $T_{sur}1$=1210° C., $T_{sur}2$=1370° C., respectively.

at the core, $T_{core}1$=1190° C. and $T_{core}2$=1345° C., respectively.

with an average core/surface difference equal to 20° C. in the first case and 25° C. in the second case, with in both cases ($T_{core}<T_{sup}$).

From the hot-rolled sheets produced, two sets of samples were obtained for each casting and hot-rolling condition.

Each of the two sets of samples was treated according to one of the two following different cycles.

Cycle A:

cold-rolling without intermediate annealing, to a thickness of 0.35 mm, with a cold reduction ratio of 83%; the rolling was carried out by simulating an interpass ageing at 240° C.×600 s to the thicknesses of 1.20 mm, 0.80 mm, 0.50 mm;

decarburization annealing at 840° C.×220 s with a ratio between partial pressure of $H_2O$ and of $H_2$ equal to 0.50;

coating with MgO-based annealing separator final annealing in a bell furnace with a rise of 15° C./h up to 1200° C. in Nitrogen+Hydrogen 1:1, a stop at 1200° C. in Hydrogen for 15 h.

Cycle B:

Like Cycle A, where in addition the sheet prior to the cold-rolling was subjected to the following annealing:

1100° C.×60 s, cooling to 780° C. and water quenching.

The magnetic characteristics measured on the final products for the various groups of samples treated are reported in Table 8.

TABLE 8

Magnetic characteristics measured on the final products

| | Two-step hot-rolling with intermediate annealing (*) | | One-step hot-rolling (**) (Tsur = 1370° C.) | | One-step hot-rolling (**) (Tsur = 1210° C.) | |
|---|---|---|---|---|---|---|
| | B800 [T] | P17 [W/kg] | B800 [T] | P17 [W/kg] | B800 [T] | P17 [W/kg] |
| Cycle A | 1885 | 1.23 | 1780 | 1.7 | 1600 | 3.1 |
| Cycle B | 1935 | 1.12 | 1860 | 1.35 | 1580 | 3.2 |

(*) Conditions complying with the invention (**) Conditions not complying with the invention

EXAMPLE 5

A steel having the following chemical composition was cast:

Si: 3.10%, C: 600 ppm, Al: 290 ppm, Cr: 700 ppm, N: 100 ppm, Mn: 0.22%, S: 70 ppm, Cu: 0.25%, Sn: 800 ppm, P: 80 ppm, the remaining part being Fe and unavoidable impurities, in different flat semiproducts of thickness equal to 85 mm.

On the basis of the above-defined chemical composition, the following quantities were calculated:

$$\frac{[N]}{M_N} = 7.1$$

$$\frac{\left([S] + \frac{32}{79}[Se]\right)}{M_S} = 2.2$$

$$F_N = 24$$

$$F_S = 79$$

The complete solidification time was of 2 min 30 s for all semiproducts.

Cast semiproducts were subdivided into three groups and subjected to three different hot-rolling procedures.

A first group was rolled, according to the teachings of this invention, during cooling, with a reduction ratio of 75% after a time of 60 s from complete solidification of the semi-finished products, until producing semi-finished products having a thickness of 21.2 mm, under the following thermal conditions:

$T_{sur}$ (at 20% of the thickness)=1200° C.

$T_{core}$ (at mid-thickness)=1350° C.

$T_{core}-T_{sup}$=150° C.

The semi-finished products after the first step of the hot-rolling were subjected to normalizing annealing at 1030° C. and held at this temperature for 15 min.

Immediately after discharge from the furnace, all semi-products were subjected to the second step of the hot-rolling, to a thickness of 3.5 mm, with a rolling starting temperature of 1020° C.

The two groups of semi-finished products remaining after the casting were subjected to two different hot-rolling cycles, departing from what is envisaged by the present invention. In particular, after casting they were cooled to room temperature and then subjected to heating, the first group at a temperature of 1180° C. and the second group at a temperature of 1380° C. All semiproducts were then held at the respective heating temperatures for a 30-min time. After this heating the semi-finished products were hot-rolled without intermediate annealings, to a thickness of 3.5 mm.

All hot-rolled sections produced, for each of the three hot-rolling conditions adopted, were subjected to the following thermomechanical treatments:

- annealing of the hot-rolled section at 1100° C.×60 s, cooling to 790° C. and water quenching;
- cold-rolling with the following procedures, until obtaining strips having 6 different final thicknesses per each hot-rolling condition:
  - single stage without intermediate annealings, to the thicknesses of 0.50 mm and 0.35 mm, respectively with cold reduction ratios of 86% and 90%;
  - double stage with a first rolling to 2.0 mm, annealing at 980° C.×60 s followed by quenching, second cold-rolling to the thicknesses of 0.30 mm, 0.27 mm, 0.23 mm, with cold reduction ratios of 85%, 87% and 89%, respectively;
  - double stage with a first rolling to 1.70 mm, annealing at 980° C.×60 s followed by quenching, second cold-rolling to the thickness of 0.18 mm, with a cold reduction ratio of 89%;
  - double stage with a first rolling to 1.00 mm, annealing at 980° C.×60 s followed by quenching, second cold-rolling to the thickness of 0.30 mm, with a cold reduction ratio of 70%;
- the rolling was carried out by simulating an interpass ageing at 240° C.×600 s; the intermediate thicknesses (after the first rolling) and the interpass ageing thicknesses are reported in Table 9;
- after cold-rolling, the strips for each of the two hot-rolling conditions and for each of the seven cold-rolling conditions were subdivided into two groups, in order to be subjected to two different treatments of decarburization and primary recrystallization:

Treatment A:

decarburization annealing and primary recrystallization at 820° C.×230 s, with a ratio between partial pressure of $H_2O$ and of $H_2$ equal to 0.50.

Treatment B:

decarburization annealing and primary recrystallization as in treatment A, with the variant that the anneal heating was carried out by electro-magnetic induction with a heating rate, in the temperature range 200° C.-700° C., higher than 150° C.;

obtaining 28 different variants of the process.

All strips were subjected to secondary recrystallization annealing, upon coating with MgO-based annealing separator, with a heating rate of 15° C./h, to 1200° C., in Nitrogen+Hydrogen 1:1, and a stop at 1200° C. in Hydrogen for 10 h.

TABLE 9

Thicknesses of the cold-rolled section, intermediate product (in case of double-pass rolling) and related interpass ageing thicknesses.

| Cold-rolling procedure # | Final thickness [mm] | Thickness after the first cold-rolling pass [mm] | Interpass ageing thicknesses |
|---|---|---|---|
| 1 | 0.50 | 0.50 (single-pass) | Interpass ageing at the following thicknesses: 1.00 mm, 0.75 mm. |
| 2 | 0.35 | 0.35 (single-pass) | Interpass ageing at the following thicknesses: 0.80 mm, 0.50 mm. |
| 3 | 0.30 | 2.00 | Interpass ageing at the following thicknesses: 0.67 mm, 0.43 mm. |
| 4 | 0.27 | 2.00 | Interpass ageing at the following thicknesses: 0.60 mm, 0.40 mm. |
| 5 | 0.23 | 2.00 | Interpass ageing at the following thicknesses: 0.55 mm, 0.35 mm. |
| 6 | 0.18 | 1.70 | Interpass ageing at the following thicknesses: 0.50 mm, 0.30 mm. |
| 7 | 0.30 | 1.00 | Interpass ageing at the following thicknesses: 0.67 mm, 0.43 mm. |

The magnetic characteristics, measured on the final product, are reported in Table 10.

TABLE 10

Magnetic characteristics measured on final products

| | | | Two-step hot rolling with an intermediate annealing (*) | | | | Hot-rolling in single stage heating T: 1370° C. (**) | | | | Hot-rolling in single stage heating T: 1200° C. (**) | | | |
|---|---|---|---|---|---|---|---|---|---|---|---|---|---|---|
| | Film | Cold reduction | Cycle (A) | | Cycle (B)) | | Cycle (A) | | Cycle (B) | | Cycle (A) | | Cycle (B) | |
| Cold-rolling procedure # | thickness [mm] | ratio in the last pass | B800 [mT] | P17 [W/kg] | B800 [mT] | P17 [W/kg] | B800 [mT] | P17 [W/kg] | B800 [mT] | P17 [W/kg] | B800 [mT] | P17 [W/kg] | B800 [mT] | P17 [W/kg] |
| 1 | 0.50 | 86% | 1939 | 1.30 | 1942 | 1.27 | 1870 | 1.38 | 1872 | 1.35 | 1600 | 3.5 | 1610 | 3.6 |
| 2 | 0.35 | 90% | 1935 | 1.18 | 1938 | 1.10 | 1880 | 1.21 | 1880 | 1.18 | 1600 | 2.9 | 1580 | 2.9 |
| 3 | 0.30 | 85% | 1939 | 1.00 | 1942 | 0.96 | 1915 | 1.05 | 1917 | 1.01 | 1610 | 2.8 | 1590 | 2.8 |
| 4 | 0.27 | 87% | 1935 | 0.95 | 1943 | 0.90 | 1920 | 1.02 | 1919 | 0.98 | 1590 | 3 | 1605 | 2.9 |
| 5 | 0.23 | 89% | 1920 | 0.94 | 1925 | 0.86 | 1890 | 0.99 | 1900 | 0.97 | 1570 | 2.9 | 1585 | 3 |
| 6 | 0.18 | 89% | 1930 | 0.92 | 1932 | 0.84 | 1700 | 1.35 | 1720 | 1.30 | 1605 | 2.9 | 1605 | 2.9 |
| 7 | 0.30 | 70% | 1850 | 1.30 | 1865 | 1.22 | 1810 | 1.40 | 1830 | 1.34 | 1600 | 2.7 | 1610 | 2.8 |

(*) Conditions complying with the invention (**) Conditions not complying with the invention

EXAMPLE 6

A series of flat semi-finished products having the following chemical composition was produced:

Si: 3.15%, C: 440 ppm, Al: 280 ppm, Nb: 500 ppm, N: 80 ppm, Mn: 0.22%, S: 70 ppm, Cu: 0.25%, Sn: 850 ppm, the remaining part being Fe and unavoidable impurities.

On the basis of the above-defined chemical composition the following quantities were calculated $$\frac{[N]}{M_N} = 5.7$$

$$\frac{\left([S] + \frac{32}{79}[Se]\right)}{M_S} = 2.2$$

$$F_N = 16$$

$$F_S = 79$$

The thickness of the cast semi-finished products was of 75 mm. Cooling conditions were adopted for the cast semi-finished products such as to have a solidification time of 4 min.

The semi-finished products produced were subdivided into two groups subjected to two different hot-rolling conditions.

The semi-finished products of the first group were hot-rolled with the procedure of the two-step rolling with an intermediate annealing according to the teachings of the present invention, with the following process conditions:

time elapsed between completion of solidification and start of the first step of the rolling: 90 s;

$T_{sur.}$ (measured at 20% of the thickness)=1205° C.;

$T_{core}$ (measured at 50% of the thickness)=1300° C.;

with a $T_{core}-T_{sup}$ difference=95° C.;

reduction ratio equal to 69%;

thickness after first step of the rolling: 23.2 mm;

normalizing annealing temperature after first step of the rolling: 1130° C.;

normalizing annealing length: 3 min;

starting temperature of the second step of the rolling: 1125° C.

hot-rolled section thickness: 2.5 mm.

Departing from the teachings of the present invention, the second group of semi-finished products after casting was hot-rolled, upon heating up to 1200° C. for 20 min, in single stage without intermediate annealings, to a thickness of 2.5 mm.

All hot-rolled sections produced, for each of the two hot-rolling conditions adopted, were subjected to the following 2 cycles of thermomechanical treatments.

Cycle A:

annealing of the hot-rolled sheet with two stops (1150° C. for 15 s, cooling to 900° C. and treatment at this temperature for 60 s, cooling to 790° C.) and water quenching;

cold-rolling in single stage until obtaining strips having a thickness of 0.30 mm, with a cold reduction ratio of 88% and an interpass ageing carried out at 220° C. for 500 s, to the following intermediate thicknesses:

1.50 mm, 1.00 mm, 0.67 mm, 0.43 mm;

decarburization annealing and primary recrystallization at 850° C. for 160 s with a ratio between partial pressure of $H_2O$ and of $H_2$ equal to 0.58;

after decarburization and primary recrystallization the strips were subdivided into 6 groups per each hot-rolling condition, to be subjected to a series of 5 different nitriding annealings at 820° C. under wet Nitrogen+Hydrogen atmosphere containing 5 different amounts of ammonia; one of the six groups was not subjected to nitriding treatment.

Post-nitriding, total Nitrogen contents measured in the strips treated under the five different nitriding conditions were:

120 ppm, 150 ppm, 190 ppm, 210 ppm, 300 ppm.

MgO-based annealing separator was coated on all strips thus obtained; then, those were annealed in a bell furnace with a heating rate of 12° C./h, up to 1200° C. under Nitrogen+Hydrogen 1:3, a stop at 1200° C. in Hydrogen for 10 h.

Cycle B:

Like Cycle A, sending the semiproducts directly to the cold-rolling without them being subjected to hot-rolled sheet annealing.

The magnetic characteristics measured on the final product are reported in Table 11, where the range reported represents the standard error with a 95% confidence interval (±2σ) on the measurements performed on 10 samples (300×30) mm per each different condition adopted.

TABLE 11

Measured magnetic characteristics

| | Two-step hot-rolling with an intermediate annealing (*) | | | | Hot-rolling without an intermediate annealing 1200° C. (**) | | | |
|---|---|---|---|---|---|---|---|---|
| | With annealing of hot rolled sheet (Cycle A) | | Without annealing of hot-rolled sheet (Cycle B) | | With annealing of hot rolled sheet (Cycle A) | | Without annealing of hot-rolled sheet (Cycle B) | |
| Total N | B800 [T] | P17 [W/kg] | B800 [T] | P17 [W/kg] | B800 [T] | P17 [W/kg] | B800 [T] | P17 [W/kg] |
| 80 | 1905 ± 20 | 1.12 ± 0.05 | 1850 ± 30 | 1.32 ± 0.04 | 1670 ± 20 | 2.92 ± 0.04 | 1670 ± 20 | 2.9 ± 0.04 |
| 120 | 1925 ± 18 | 1.05 ± 0.03 | 1860 ± 30 | 1.30 ± 0.04 | 1650 ± 20 | 2.84 ± 0.04 | 1650 ± 20 | 2.8 ± 0.04 |
| 150 | 1930 ± 15 | 1.04 ± 0.03 | 1870 ± 20 | 1.27 ± 0.02 | 1700 ± 20 | 1.54 ± 0.02 | 1680 ± 20 | 2.4 ± 0.04 |
| 190 | 1940 ± 10 | 1.02 ± 0.02 | 1865 ± 20 | 1.23 ± 0.01 | 1850 ± 20 | 1.40 ± 0.02 | 1710 ± 30 | 1.61 ± 0.03 |
| 210 | 1939 ± 7 | 1.00 ± 0.01 | 1865 ± 15 | 1.15 ± 0.01 | 1875 ± 15 | 1.37 ± 0.02 | 1720 ± 20 | 1.54 ± 0.02 |
| 300 | 1945 ± 5 | 0.98 ± 0.01 | 1870 ± 10 | 1.13 ± 0.01 | 1875 ± 15 | 1.36 ± 0.02 | 1750 ± 20 | 1.5 ± 0.02 |

(*) Conditions complying with the invention (**) Conditions not complying with the invention

EXAMPLE 7

A series of flat semiproducts was obtained, having a thickness of 85 mm and the chemical compositions shown in Table 12.

TABLE 12

Chemical compositions of cast steels

| # | Si [%] | C [ppm] | Al [ppm] | B [ppm] | Zr [ppm] | N [ppm] | Mn [%] | S [ppm] | Cu [%] | Sn [ppm] | P [ppm] |
|---|---|---|---|---|---|---|---|---|---|---|---|
| 1 | 3.2 | 300 | 270 | 35 | — | 70 | 0.20 | 100 | 0.1 | 800 | 80 |
| 2 | 3.8 | 280 | 290 | — | 120 | 80 | 0.16 | 90 | 0.2 | 900 | 90 |
| 3 | 4.2 | 270 | 310 | — | 30 | 80 | 0.15 | 90 | 0.25 | 800 | 60 |
| 4 | 5.5 | 180 | 320 | — | 30 | 70 | 0.20 | 120 | 0.15 | 700 | 60 |

Casting and cooling conditions were controlled so as to have a complete solidification time equal to 3 min 30 s.

On the basis of the above-defined chemical composition, the quantities reported in the following Table 13 were calculated.

TABLE 13

Quantities obtained from chemical composition of cast steels

| Semiproduct # | $\frac{[N]}{M_N}$ | $\frac{\left([S]+\frac{32}{79}[Se]\right)}{M_S}$ | $F_N$ | $F_S$ |
|---|---|---|---|---|
| 1 | 5.0 | 3.1 | 13 | 52 |
| 2 | 5.7 | 2.8 | 12 | 61 |
| 3 | 5.7 | 2.8 | 12 | 67 |
| 4 | 5.0 | 3.7 | 12 | 60 |

For each chemical composition the cast semi-finished products were subdivided into two groups, hot-rolled according to two different procedures.

The first group was hot-rolled during casting, by the two-step hot-rolling technique with an intermediate annealing, according to the teachings of the present invention. Both solidification and cooling conditions were controlled, so as to have at the start of the first rolling step the following conditions:

$T_{sur}$ (at 20% of the thickness)=1190° C.

$T_{core}$ (at 50% of the thickness)=1320° C.

With a $T_{core}-T_{sur}$ difference=130° C.

time elapsed between completion of solidification and casting start: 80 sec reduction ratio of the first step of the hot-rolling: 80%;

thickness after first step of the hot-rolling: 17 mm;

normalizing annealing temperature after first step of the hot-rolling: T=1020° C.;

normalizing annealing time: 10 min;

starting temperature of the second step of hot-rolling: 1000° C.;

hot-rolled section thickness: 2.3 mm.

The remaining two semi-finished products for each chemical composition were processed, departing from the teachings of the present invention, cooling them after casting to room temperature and subjecting them, upon heating to 1150° C. for 20 min, to a hot-rolling in single stage without intermediate annealings, to a thickness of 2.3 mm.

While with the hot-rolling cycle according to the present invention it was possible to roll the semiproducts all of four chemical compositions used, with the second hot-rolling procedure it was not possible to roll the semiproducts having the chemical compositions 3 and 4 (respectively with 4.2% and 5.5% Si), in fact, already at the hot-rolling step they manifested brittleness phenomena such as to make the process impossible.

The hot-rolled sheets produced were treated according to the following cycle:

annealing of the hot-rolled sheet at 920° C.×250 s;

cooling to 780° C. and water quenching;

cold-rolling without intermediate annealing to the thickness of 0.30 mm, with a cold reduction ratio of 87% (the rolling was carried out by simulating an interpass ageing at 240° C.×600 s, to the thicknesses of 1.00 mm, 0.67 mm, 0.43 mm);

decarburization annealing and recrystallization at 830° C.×180 s with a ratio between partial pressure of $H_2O$ and of $H_2$ equal to 0.60;

coating with MgO-based annealing separator;

secondary recrystallization annealing with a heating rate of 15° C./h to 1200° C. in Nitrogen+Hydrogen 1:1, a stop at 1200° C. in Hydrogen for 10 h.

The semiproducts, hot-rolled by departing from the teachings of the present invention (direct hot-rolling without intermediate annealings) and having the chemical composition 2 (3.8% Si) were cold-rolled with great difficulties.

It was possible to achieve the final thickness for no more than 30% of the processed samples.

The samples hot-rolled according to the present invention, having chemical compositions #1, 2 and 3, were instead cold-rolled without specific problems of brittleness, whereas those having chemical composition # (5.5% Si) proved to be so brittle that it was not possible to cold-roll it in a manner such as to get a measurable sample.

The magnetic characteristics measured on the final product are reported in Table 14.

TABLE 14

Obtained magnetic characteristics

| Semiproduct # | Two-step hot-rolling with an intermediate annealing (*) B800 [T] | P17 [W/kg] | Hot-rolling in single stage (**) B800 [T] | P17 [W/kg] |
|---|---|---|---|---|
| 1 | 1930 | 1.00 | 1640 | 3.0 |
| 2 | 1900 | 0.90 | 1630 | 2.8 |
| 3 | 1890 | 0.89 | (X) | (X) |
| 4 | (X) | (X) | (X) | (X) |

(*) Conditions complying with the invention (**) Conditions not complying with the invention

EXAMPLE 8

Two alloys in the form of flat semiproducts having a thickness of 90 mm were cast, with two different Carbon contents:

alloy A-C:30 ppm alloy B-C:300 ppm

The other alloy elements are as follows:

Si: 3.20%, Al: 300 ppm, W: 50 ppm, N: 70 ppm, Mn: 0.15%, S: 150 ppm, Cu: 0.25%, Sn: 850 ppm, P: 110 ppm.

On the basis of the above-defined chemical compositions, the following quantities were calculated $$\frac{[N]}{M_N} = 5.0$$

$$\frac{\left([S] + \frac{32}{79}[Se]\right)}{M_S} = 4.7$$

$$F_N = 11$$

$$F_S = 67$$

Casting and cooling conditions were controlled so as to have a complete solidification time equal to 2 min 40 s.

The cast semi-finished products, for each of the two alloys produced, were subdivided into two groups of sections hot-rolled according to two different procedures.

The first group of semi-finished products was hot-rolled according to the teachings of this invention, by adopting the following process conditions:

cooling conditions of the cast piece regulated so as to have the following thermal conditions of the semi-finished products at the start of the first hot-rolling step:

$T_{sur}$ (at 20% of the thickness)=1180° C.

$T_{core}$ (at 50% of the thickness)=1300° C.

with a $T_{core}-T_{sur}$ difference=120° C.

start time of the first step of the hot-rolling: 40 s after complete solidification of the semiproducts;

reduction ratio of the first hot-rolling: 78%;

semi-finished product thickness after first step of hot-rolling: 20 mm normalizing annealing at the temperature of 970° C., for a time of 15 min;

temperature at the start of the second step of hot-rolling: 960° C.

annealing of the hot-rolled sheet at 1100°×60 s;

cooling to 780° C. and water quenching;

cold-rolling without intermediate annealing, to the thickness of 0.30 mm with a cold reduction ratio of 87%; the rolling was carried out by simulating an interpass ageing at 240° C.×600 s to the thicknesses of 0.90 mm, 0.60 mm, 0.45 mm.

decarburization annealing at 800° C.×300 s, with a ratio between partial pressure of $H_2O$ and of $H_2$ equal to 0.10 and 0.55, respectively for alloy A and alloy B;

coating with MgO-based annealing separator secondary recrystallization annealing in a bell furnace with a rise of 10° C./h to 1150° C. under Nitrogen+Hydrogen 1:1, a stop at 1150° C. in Hydrogen for 10 h.

During the cycle shown above, the four groups of samples were subjected to a nitriding procedure as described hereinafter:

Group A:

not nitrided;

Group B:

nitrided during the annealing of the hot-rolled sheet, by adding $NH_3$ to the annealing atmosphere, so as to introduce in the sheet 50 ppm N in addition to the 70 ppm present at casting;

Group C:

nitrided in a nitriding annealing carried out after the decarburisation annealing under wet ammonia-containing Nitrogen+Hydrogen atmosphere, so as to introduce in the sheet 50 ppm N in addition to the 70 ppm present at casting;

Group D:

processed by adding to the annealing separator, coated before the secondary recrystallization annealing, $Mn_4N$ in a concentration such that the weight percent into the MgO-based annealing separator be equal to 8%.

The magnetic characteristics obtained for the various groups of strips treated are reported in Table 15, where the reported range represents the standard error with a 95% confidence interval (±2σ) on the measurements carried out on 10 (300×30) mm samples.

TABLE 15

| | Magnetic characteristics obtained | | | | | | | |
|---|---|---|---|---|---|---|---|---|
| | Two-step hot-rolling with an intermediate annealing (*) | | | | Hot-rolling in single stage (**) | | | |
| | Alloy A | | Alloy B | | Alloy A | | Alloy B | |
| | B800 [T] | P17 [W/kg] | B800 [T] | P17 [W/kg] | B800 [T] | P17 [W/kg] | B800 [T] | P17 [W/kg] |
| Group (A) | 1835 ± 20 | 1.40 ± 0.04 | 1920 ± 20 | 1.04 ± 0.04 | 1640 ± 20 | 2.9 ± 0.04 | 1660 ± 20 | 2.9 ± 0.04 |
| Group (B) | 1840 ± 10 | 1.32 ± 0.02 | 1930 ± 8 | 1.01 ± 0.02 | 1655 ± 20 | 2.7 ± 0.03 | 1710 ± 20 | 2.7 ± 0.03 |
| Group (C) | 1860 ± 8 | 1.28 ± 0.02 | 1932 ± 9 | 1.00 ± 0.02 | 1590 ± 15 | 2.8 ± 0.03 | 1700 ± 30 | 2.6 ± 0.03 |
| Group (D) | 1865 ± 8 | 1.28 ± 0.02 | 1933 ± 9 | 1.00 ± 0.02 | 1600 ± 15 | 2.8 ± 0.03 | 1680 ± 20 | 2.7 ± 0.03 |

(*) Conditions complying with the invention (**) Conditions not complying with the invention hot-rolled section thickness: 2.3 mm.

The remaining group of semi-finished products was processed, by departing from the teachings of the present invention, cooling the semi-finished products after casting to room temperature and subjecting them, upon heating up to 1130° C. for 20 min, to hot-rolling in single stage without intermediate annealings, to a thickness of 2.3 mm.

From sheets produced with each of the two different hot-rolling cycles there were obtained four groups of samples, for each alloy produced, subjected to the following process steps:

The invention claimed is:

1. A process for the production of grain oriented magnetic strip wherein a silicon steel is continuously cast to form a slab, solidified and subjected to the following operations in sequence:

hot-rolling of the slab to obtain a hot-rolled sheet;

cooling of the hot-rolled sheet and coiling thereof;

optional annealing of the hot-rolled sheet;

cold-rolling the hot-rolled sheet until obtaining a cold-rolled strip;

decarburization annealing and primary recrystallization of the cold-rolled strip;

applying of an annealing separator onto a surface of the cold-rolled strip;

secondary recrystallization annealing of the cold-rolled strip, and wherein the hot-rolled sheet and/or the cold-rolled strip is optionally nitrided, characterised in that:

the steel comprises the following components, expressed in weight concentration:

Si between 2.3% and 5.0%,

N in the range of 20-200 ppm,

S and/or Se so that (S+(32/79)Se) be in the range of between 30 and 350 ppm, at least two elements of the series B, Al, Cr, V, Ti, W, Nb, Zr and at least one of the elements of the series Mn, Cu, such that the two quantities:

$$F_N = \frac{[B]}{M_B} + \frac{[Al]}{M_{Al}} + \frac{[Cr]}{M_{Cr}} + \frac{[V]}{M_V} + \frac{[Ti]}{M_{Ti}} + \frac{[W]}{M_W} + \frac{[Nb]}{M_{Nb}} + \frac{[Zr]}{M_{Zr}}$$

$$F_S = \frac{[Mn]}{M_{Mn}} + \frac{[Cu]}{M_{Cu}}$$

where [X] in $$\frac{[X]}{M_X}$$

represents the weight concentration of element expressed in ppm and $M_x$ the related atomic weight, is such as to satisfy the following relationships:

$$1.5 \cdot \left(\frac{[N]}{M_N}\right) < F_N < 40$$

$$\frac{[S] + \frac{32}{79}[Se]}{M_S} < F_S < 100;$$

optionally C up to 800 ppm, Sn, Sb, As in concentrations such that their sum does not exceed 1500 ppm and/or P, Bi, in concentrations such that their sum does not exceed 300 ppm, the remaining part being iron and unavoidable impurities, and in that the slab, solidified in a time less than 6 minutes, is subjected, in the absence of a heating prior to the hot-rolling, to the following operations in sequence:

first step of the hot-rolling to a thickness of 15-30 mm, with a reduction ratio of at least 50%; said hot rolling being carried out in a time interval lower than 100 s after complete solidification of the steel at a surface temperature ($T_{sur}$), before the start of said rolling, between 1050° C. and 1300° C. and a core temperature ($T_{core}$) between 1100° C. and 1400° C., as well as a difference ($T_{core}-T_{sur}$) greater than 30° C. (with $T_{core}$ always greater than $T_{sur}$), the surface temperature $T_{sur}$ being the temperature of the slab at a depth equal to 20% of the thickness and the core temperature $T_{core}$ the temperature at the core of the slab thickness;

normalizing annealing of the hot-rolled sheet at a temperature of 900-1150° C. for a time of 1-30 min;

second step of the hot-rolling at rolling starting temperatures between 880° C.-1150° C., until obtaining a sheet of <5 mm thickness.

2. The process according to claim 1, wherein the steel comprises at least 250 ppm C and between 200 ppm and 400 ppm Al, and the sheet after hot-rolling, cooling and coiling is subjected to annealing for an overall time of 20-300 s with one or more steps at temperatures higher than 850° C., followed by cooling down to a quenching starting temperature in the range of 750-850° C. and subsequently quenching, in water.

3. The process according to claim 1 or 2, wherein the cold-rolling of the sheet is carried out in single pass, or in multiple passes with an intermediate annealing followed by quenching, the cold rolling being carried out in plural steps with a reduction ratio of at least 80%, holding the sheet temperature at a value between 170 and 300° C., prior to at least two rolling steps subsequent to the first step.

4. The process according to claim 1, wherein the decarburization annealing and primary recrystallization of the sheet is carried out at a temperature comprised between 780° C. and 900° C. under wet Nitrogen+Hydrogen atmosphere, such that the ratio between partial pressure of $H_2O$ and partial pressure of $H_2$ be lower than 0.70 for a time between 20 and 300 s.

5. The process according to claim 1, wherein the decarburization annealing and primary recrystallization is carried out with a heating rate of at least 150° C./s in the temperature range between 200° C. and 700° C.

6. The process according to claim 1, wherein the secondary recrystallization annealing is carried out on the strip with a heating gradient between 10 and 40° C./h to a temperature between 1000 and 1250° C., under Nitrogen+Hydrogen atmosphere, holding this temperature, under Hydrogen atmosphere, for a time between 5 and 30 h.

7. The process according to claim 1, wherein after the hot-rolling, in at least one subsequent annealing, the sheet and/or the strip is continuously nitrided, making it absorb a Nitrogen content between 30 ppm and 300 ppm.

8. The process according to claim 1, wherein the sheet is nitrided during the secondary recrystallization annealing, in the temperature range between the annealing starting temperature and the temperature at which the secondary recrystallization ends, with a nitriding operation selected from:

use of an annealing atmosphere comprising Nitrogen in a weight concentration between 80% and 95%, addition of metal nitrides capable of releasing Nitrogen in the temperature range between 700° C. and 950° C., in amounts such that the weight concentration of Nitrogen added to the separator be between 0.5% and 3%, and combinations thereof.

9. The process according to claim 1, wherein the applying of the annealing separator is carried out with a separator comprising substantially MgO.

* * * * *